US010669691B2

(12) United States Patent
Tinker et al.

(10) Patent No.: US 10,669,691 B2
(45) Date of Patent: Jun. 2, 2020

(54) AUTOMATIC DIG ASSISTANCE SYSTEM FOR A MACHINE

(71) Applicant: Caterpillar Inc., Deerfield, IL (US)

(72) Inventors: Matthew M. Tinker, Peoria, IL (US); Michael A. Spielman, Brookfield, IL (US); Eric Cler, Oswego, IL (US); Aaron R. Shatters, Montgomery, IL (US); Austin J. Scott, Naperville, IL (US); Jeffrey K. Berry, Yorkville, IL (US); Sairam G. Velamakanni, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 188 days.

(21) Appl. No.: 15/987,721

(22) Filed: May 23, 2018

(65) Prior Publication Data

US 2019/0360169 A1 Nov. 28, 2019

(51) Int. Cl.

| | |
|---|---|
| ***E02F 9/20*** | (2006.01) |
| ***E02F 3/43*** | (2006.01) |
| ***E02F 9/22*** | (2006.01) |
| ***E02F 3/28*** | (2006.01) |

(52) U.S. Cl.

CPC ..... *E02F 3/431* (2013.01); *E02F 3/283* (2013.01); *E02F 9/2004* (2013.01); *E02F 9/2029* (2013.01); *E02F 9/22* (2013.01)

(58) Field of Classification Search

CPC ..... E02F 3/431; E02F 3/283; E02F 9/2004; E02F 9/2029; E02F 9/22

See application file for complete search history.

(56) References Cited

U.S. PATENT DOCUMENTS

| | | | | |
|---|---|---|---|---|
| 5,528,843 | A | 6/1996 | Rocke | |
| 5,941,921 | A | 8/1999 | Dasys et al. | |
| 5,968,103 | A | 10/1999 | Rocke | |
| 6,064,933 | A | 5/2000 | Rocke | |
| 6,205,687 | B1 | 3/2001 | Rocke | |
| 6,879,899 | B2 * | 4/2005 | Budde | E02F 3/432 172/2 |
| 7,555,855 | B2 | 7/2009 | Alshaer et al. | |
| 9,587,369 | B2 | 3/2017 | Fletcher et al. | |
| 9,702,115 | B1 | 7/2017 | Darukhanavala | |
| 2017/0066448 | A1 | 3/2017 | Hertel et al. | |

* cited by examiner

*Primary Examiner* — Todd M Melton

(74) *Attorney, Agent, or Firm* — Bookoff McAndrews

(57) ABSTRACT

A system for controlling an earth moving machine may comprise: a speed sensor configured to communicate a speed signal indicative of a speed of the machine; an operator bucket lift command input configured to communicate an operator-input bucket lift command; and a controller configured to: receive the speed signal and the operator-input bucket lift command; determine a torque of the machine; using the speed signal and the determined torque, determine a controller-generated bucket lift command; and provide a bucket lift command which is the larger of the operator-input bucket lift command and the controller-generated bucket lift command.

20 Claims, 3 Drawing Sheets

AUTOMATIC DIG ASSISTANCE SYSTEM FOR A MACHINE

TECHNICAL FIELD

The present disclosure relates generally to a digging and loading machine and, more particularly, to an automatic dig assistance system for a such a machine.

BACKGROUND

Earth moving machines, such as wheel loaders, are frequently used at work sites to perform processes including digging, loading, and site cleanup. For example, a machine may repetitively load material into its bucket and dump the material into the bed of a truck. An earth moving machine may also push small amounts of material to another location. Such operations involve repetitious work cycles that can become tedious to an operator and the operator may become fatigued. A fatigued or inexperienced operator may work less efficiently, thereby adversely impacting the efficiency of the machine. For example, during a loading operation, tires of a machine may fail to gain sufficient traction and may, for example, spin when the bucket engages a pile of material. Such lack of traction may result in inefficiencies in work pace, wear on parts of the machine, including the tires, and/or excessive fuel consumption.

To prevent adverse effects due to fatigue or inexperience and maintain a high level of machine productivity and efficiency, some machines are equipped with controllers that automate portions of the repetitive work process and/or portions of the work process that are sensitive to precise dynamic timing of the operator inputs. These controllers typically rely upon measured cylinder pressures and positions to determine when to implement an action or a step to load the bucket of the machine. However, these controllers may fail to distinguish between activities involving loading or activities not involving loading, such as site cleanup. These controllers may also override the commands of skilled operators. In addition, these controllers may not result in the tires of a machine being adequately set.

U.S. Pat. No. 7,555,855 (the "'855 patent"), issued to Alshaer et al. on Jul. 7, 2009, describes a loading control system, which includes a lift sensor, a tilt sensor, and a speed sensor. The '855 patent describes controlling outputs including a rim-pull, lift velocity, tilt velocity, and machine speed based on inputs from a lift signal, tilt signal, and speed signal. However, the systems of the '855 patent is not designed to distinguish between instances where digging is desired and instances where digging is not desired. Furthermore, the systems of the '855 patent does not address whether tires of the machine are adequately set, or provide for operator override of lift commands. The system of the present disclosure may solve one or more of the problems set forth above and/or other problems in the art. The scope of the current disclosure, however, is defined by the attached claims, and not by the ability to solve any specific problem.

SUMMARY

In one aspect, a system for controlling an earth moving machine may comprise: a speed sensor configured to communicate a speed signal indicative of a speed of the machine; an operator bucket lift command input configured to communicate an operator-input bucket lift command; and a controller configured to: receive the speed signal and the operator-input bucket lift command; determine a torque of the machine; using the speed signal and the determined torque, determine a controller-generated bucket lift command; and provide a bucket lift command which is the larger of the operator-input bucket lift command and the controller-generated bucket lift command.

In another aspect, a method for controlling an earth moving machine may comprise: receiving a speed signal indicative of a speed of the machine; determining a torque of the machine; receiving an operator-input bucket lift command; using the received speed signal and the determined torque, determining a controller-generated bucket lift command; and providing a bucket lift command which is the larger of the operator-input bucket lift command and the controller-generated bucket lift command.

In yet another aspect, a system for controlling an earth moving machine may comprise: a speed sensor configured to communicate a speed signal indicative of a speed of the machine; a pressure sensor configured to communicate a pressure signal indicative of the pressure on a bucket of the machine; and a controller configured to: determine a torque of the machine; and using the speed signal, the determined torque, and the pressure signal, determine whether a pile encountered by the machine is a full pile.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of material that is excavated (e.g., dirt, rocks, clay, sand, asphalt, cement, etc.). In this disclosure, the term "sensor" encompasses all types of sensors including physical sensors and virtual sensors. In this disclosure, relative terms, such as, for example, "about," substantially," and "approximately" are used to indicate a possible variation of ±10% in the stated value. Although the current disclosure is described with reference to a wheel loader, this is only exemplary. In general, the current disclosure can be applied as to any machine, such as, for example, load-haul-dump machines (LHDs), carry dozers, etc.

Figure 1:
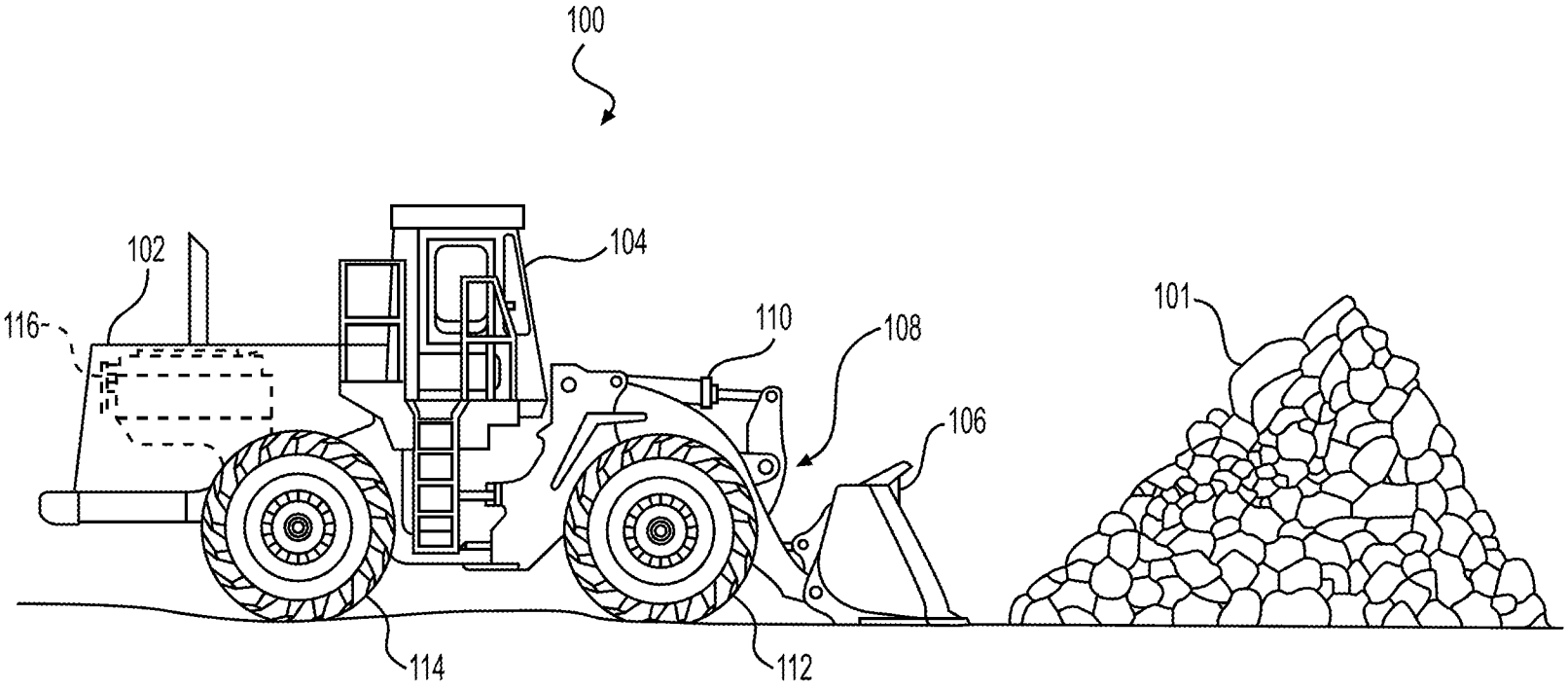
FIG. 1 is an illustration of an exemplary earth moving machine approaching a pile of material.

As shown in FIG. 1, a earth moving machine 100 approaches a pile 101 of material. Machine 100 may include an engine housing 102, an operator station 104, and a bucket 106 for digging and loading material. Bucket 106 may also be a different work implement. In the example of machine 100 being a wheel loader, bucket 106 may be powered and controlled by a lift actuator 108 and a tilt actuator 110. Lift actuator 108 and/or tilt actuator 110 may be, for example, hydraulic fluid cylinder actuators. However, lift and tilt actuators 108, 110 could be other actuators, as would be apparent to one skilled in the art.

The machine 100 may include ground surface engaging devices, such as front wheels 112 and rear wheels 114, that support machine 100. The engine housing 102 may include an engine 116 that may be configured to drive a transmission that may provide power to the front and/or rear wheels 112, 114. While a wheeled machine is shown and described, one skilled in the art will appreciate that other machines, including track-type machines, may also be utilized. For example, in a track-type machine, a rim described below would be equivalent to a sprocket in a track-type machine, a wheel described below would be equivalent to a track, and a rim-pull described below would be equivalent to a drawbar pull.

The pile 101 of material may include any of a variety of materials that may be loaded into bucket 106 and dumped at another location. For example, pile 101 may include gravel, sand, dirt, and the like. Alternatively, pile 101 may be an embankment or hill formed of a tough material, such as clay, embedded rocks, or other tough material. Machine 100 may encounter any number of variations in piles of material to be loaded during its course of operation. For example, pile 101 may be a small amount of material that is to be pushed by bucket 106 or otherwise loaded into bucket 106 for the purpose of performing site cleanup. It is understood that the reference to piles 101 of material encompasses any material to be loaded and/or moved.

Figure 2:
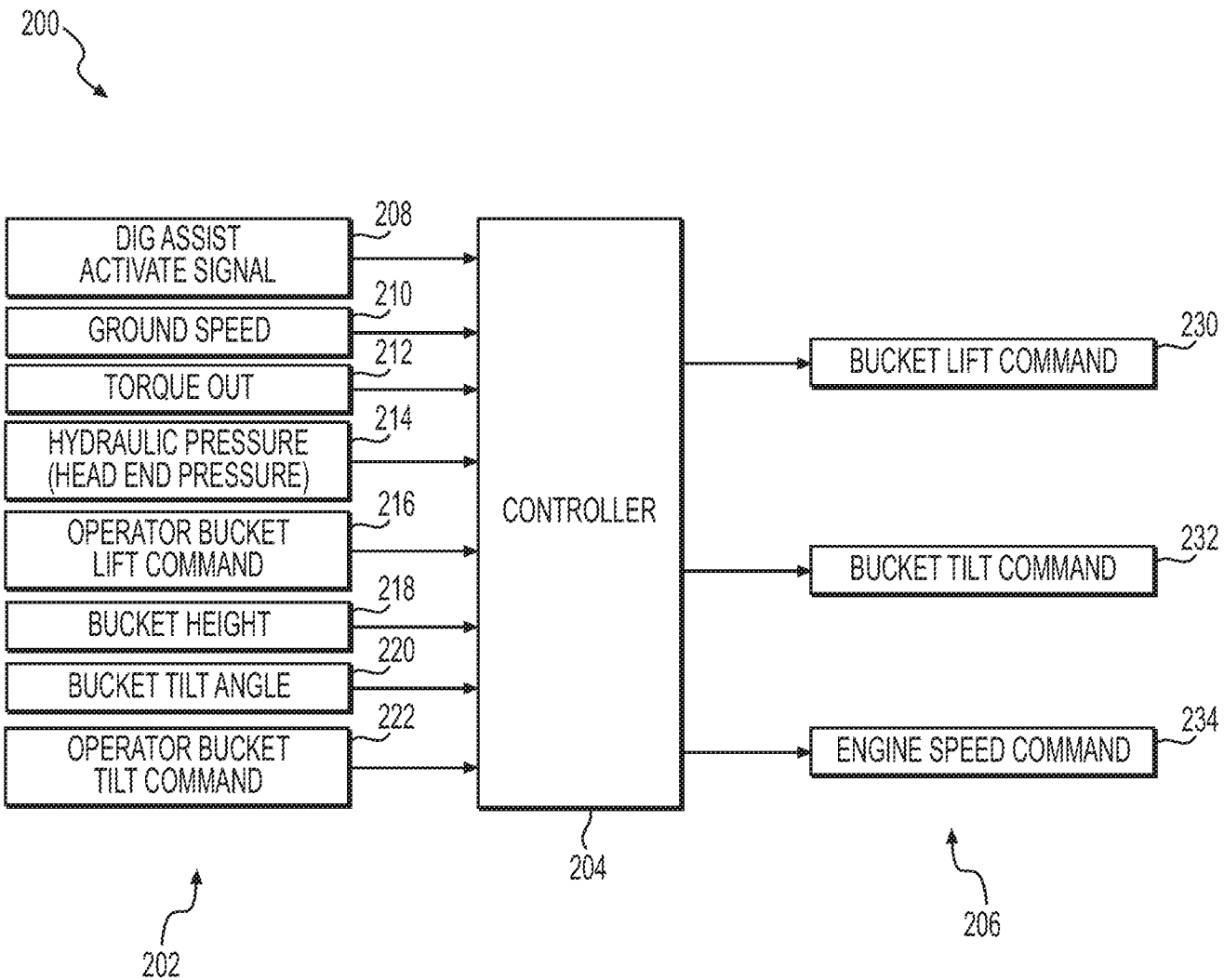
FIG. 2 is a block diagram of an exemplary control system for the machine of FIG. 1.

FIG. 2 illustrates an exemplary dig assist system 200 that may be utilized with machine 100 for operation and/or control of at least portions of machine 100. Dig assist system 200 may include inputs 202, a controller 204, and outputs 206. Inputs 202 may include, for example, signals regarding a dig assist activate signal 208, ground speed 210, torque out 212, hydraulic pressure 214 (e.g., lift cylinder head end and rod end pressure for a lift cylinder controlled by lift actuator 108), operator bucket lift command 216, bucket height 218, bucket tilt angle 220, and/or operator bucket tilt command 222. Outputs 206 may include, for example, bucket lift command 230, bucket tilt command 232, and/or wheel torque limit command/engine speed limit command 234.

Controller 204 may embody a single microprocessor or multiple microprocessors that may include means for monitoring operations of machine 100, detecting properties of pile 101, and issuing instructions to components of machine 100. For example, controller 204 may include a memory, a secondary storage device, a clock, and a processor, such as a central processing unit or any other means for accomplishing a task consistent with the present disclosure. The memory or secondary storage device associated with controller 204 may store data and/or software routines that may assist controller 204 in performing its functions. Further, the memory or storage device associated with controller 204 may also store data received from the various inputs 202 associated with work machine 100. Numerous commercially available microprocessors can be configured to perform the functions of controller 204. It should be appreciated that controller 204 could readily embody a general machine controller capable of controlling numerous other machine functions. Various other known circuits may be associated with controller 204, including signal-conditioning circuitry, communication circuitry, hydraulic or other actuation circuitry, and other appropriate circuitry.

Dig assist activate signal 208 may indicate whether or not dig assist system 200 is activated or turned on. Dig assist system 200 may be configured so as to be activated anytime machine 100 is operated. In addition or in the alternative, a manual override may be provided allowing an operator to disable dig assist system 200, which may be activated by default. In addition or in the alternative, machine 100 may be configured so that an operator may actively enable and/or disable dig assist system 200. Dig assist system 200 may be enabled and/or disabled via, for example, a mechanism or switch such as a toggle switch within operator station 104 of machine 100. Any other mechanism may be provided for enabling and/or disabling dig assist system 200. Signal 208 may indicate whether or not dig assist system 200 is enabled or disabled.

Ground speed input 210 may be a sensor (e.g., a speed sensor) which may be configured to detect a speed of machine 100 by monitoring any machine component that may be indicative of the speed or velocity of machine 100. Ground speed input 210 may communicate a speed signal indicative of a speed of machine 100 to controller 204. For example, ground speed input 210 may monitor the speed of engine 116. In other examples, ground speed input 210 may monitor a transmission output speed or a rotation of wheels 112, 114. For example, ground speed input 210 may embody a conventional rotational speed detector having a stationary element rigidly connected to a frame of machine 100 that is configured to sense a relative rotational movement of a wheel 112 and/or 114 (e.g., of a rotating portion of machine 100 that is operatively connected to wheel 112 and/or 114, such as an axle, a gear, a cam, a hub, a final drive, etc.). The stationary element may be a magnetic or optical element mounted to an axle housing (e.g., to an internal surface of the housing) and configured to detect rotation of an indexing element (e.g., a toothed tone wheel, an embedded magnet, a calibration stripe, teeth of a timing gear, a cam lobe, etc.) connected to rotate with one or more of wheels 112 and/or 114. The indexing element may be connected to, embedded within, or otherwise form a portion of the front axle assembly that is driven to rotate by engine 116. A sensor of ground speed input 210 may be located adjacent the indexing element and configured to generate a signal each time the indexing element (or a portion thereof, for example a tooth) passes near the stationary element. This signal may be directed to controller 204, which may use this signal to determine a distance traveled by machine 100 between signal generation times (i.e., to determine a travel speed of machine 100). Controller 204 may record the traveled distances and/or speed values associated with the signal in a memory or other secondary storage device associated with controller 204. Alternatively or additionally, controller 204 may record a number of wheel rotations, occurring within fixed time intervals, and use this information along with known kinematics of wheel 112 and/or 114 to determine the distance and speed values. Other systems and methods may be used to monitor the speed of the machine 100, including, for example, global navigation satellite system (GNSS) receivers, accelerometers, and/or radar. The ground speed input 210 may be configured to communicate a signal indicative of the speed of the machine 100 to controller 204.

Torque out input 212 may be a sensor or other mechanism configured to detect and/or communicate a torque out of engine 116 of machine 100. For example, torque out input 212 may include a torque sensor. A torque sensor may be physically associated with engine 116 or may be a virtual sensor used to calculate a torque out based on sensed parameters such as fueling of engine 116, speed of engine 116, and/or a drive ratio of a transmission or final drive. Torque out input 212 may also include a sensor such as an accelerometer. Torque out input 212 may measure any kind of torque including, for example, an torque of an engine or a transmission or a torque to wheels 112, 114. Additionally or alternatively, drivetrain propulsion torque may be determined using a number of known techniques, including, for example: (a) engine output torque minus accessory torque demands for a machine having a torque converter with a lock-up clutch engaged; (b) torque converter output torque as calculated from impeller speed, turbine speed, and empirically measured relationships; (c) driveline hydraulic pump supply torque (pressure & displacement); and (d) electric drivetrain motor supply torque, along with associated gear ratios and efficiency losses from the drivetrain torque source to wheels 112, 114. These driveline torque determination techniques may be adjusted based on mechanical elements which impact the actual torque supplied to wheels 112, 114, such as, for example, (a) a torque converter impeller clutch, which can be controlled to slip in order to allocate engine torque between (1) torque used for propulsion of machine 100 and/or driveline torque and (2) torque supplied to hydraulic implements (e.g., those controlled by lift actuator 108 and/or tilt actuator 110); (b) effective reduction in propulsion torque due to application of braking or retarding systems of machine 100. Torque out input 212 may also communicate information regarding a rim-pull on machine 100. As used herein, rim-pull is meant to include the power or drive torque between wheels 112 and/or 114 and a ground surface. For example, increasing the rim-pull is meant to mean increasing the forward force of the machine 100 as transferred from the wheels 112 and/or 114 to a ground surface. Torque out input 212 may also include any number and type of sensors and/or other inputs. For example, torque input 212 may consider torque on bucket 106.

Hydraulic pressure input 214 may be a sensor for detecting a net force acting on a lift cylinder, which may be controlled by a lift actuator 108. Forces acting on a lift cylinder may include a head end pressure and a rod end pressure. Rod end pressure may be low so that a net force acting on a lift cylinder may be approximated as a head-end pressure. For example, hydraulic pressure input 214 may be a pressure sensor configured to communicate a pressure signal to controller 204. For example, hydraulic pressure input 214 may include a lift pressure sensor and/or a tilt pressure sensor. For example, a lift pressure sensor and a tilt pressure sensor may be associated with lift actuator 108 and tilt actuator 110 so as to detect pressure of fluid within the respective actuator. For example, a lift sensor may be disposed within a head of lift actuator 108, and a tilt sensor may be disposed within a head of tilt actuator 110. In the alternative, any sensors associated with hydraulic pressure input 214 may be disposed in other locations relative to an actuator such as lift actuator 108 or tilt actuator 110 or a hydraulic system associated with an actuator. Hydraulic pressure input 214 may also derive pressure information from other sources, including other sensors.

Operator bucket lift command input 216 may be a command from an operator in operator station 104 and/or from a remote operator. For example, operator bucket lift command input 216 may be an operator bucket lift command input configured to communicate an operator-input lift command to controller 204. Operator bucket lift command input 216 may indicate a desire to cause actuation of lift actuator 108 and, in turn, change in height of bucket 106.

Bucket height input 218 may include sensors and/or other inputs configured to provide information about a height of bucket 106. For example, bucket height input 218 may be a bucket height sensor configured to communicate a bucket height signal to controller 204. For example, bucket height input 218 may provide information abut a height of a B-pin, a lower surface, and/or a tip of bucket 106 with respect to a ground surface or another reference point. For example, bucket height input 218 may include a magnetic pick-up type sensor embedded within lift actuator 108, magnetostrictive-type sensors associated with a wave guide internal to lift actuator 108, cable type sensors associated with cables externally mounted to lift actuator 108, internally- or externally-mounted optical sensors, rotary style sensors associated with joints pivotable by lift actuators 108, LIDAR, RADAR, SONAR, camera-type sensors, or any other type of height-detection sensors known in the art. Bucket height input 218 may also include information from other sources.

Bucket tilt angle input 220 may include sensors and/or other inputs configured to provide information about a tilt of bucket 106. For example, bucket tilt angle input 220 may be a bucket tilt angle sensor configured to communicate a bucket tilt angle sensor to controller 204. For example, bucket tilt angle input 220 may include sensors such as magnetic pickup-type sensors embedded within tilt actuator 110, magnetostrictive-type sensors associated with a wave guide internal to tilt actuator 110, cable type sensors associated with cables externally mounted to tilt actuator 110, internally- or externally-mounted optical sensors, rotary style sensors associated with joints pivotable by tilt actuator 110, or any other type of angle-detection sensors known in the art. Bucket tilt angle input 220 may also include information from other sources.

Operator bucket tilt command input 222 may be a command from an operator in operator station 104 and/or from a remote operator. For example, operator bucket tilt command input 222 may be an operator bucket tilt command input configured to communicate an operator-input tilt command to controller 204. Operator bucket tilt command input 222 may indicate a desire to cause actuation of tilt actuator 110 and, in turn, cause a change in angle of bucket 106.

Turning to outputs 206, bucket lift command 230 may cause actuation of lift actuator 108 and may cause a change in height of bucket 106. Bucket tilt command 232 may cause actuation of tilt actuator 110 and may cause a change in angle of bucket 106. Engine speed command 234 may be operative to change an output of engine 116, including a speed output of engine 116.

Figure 3:
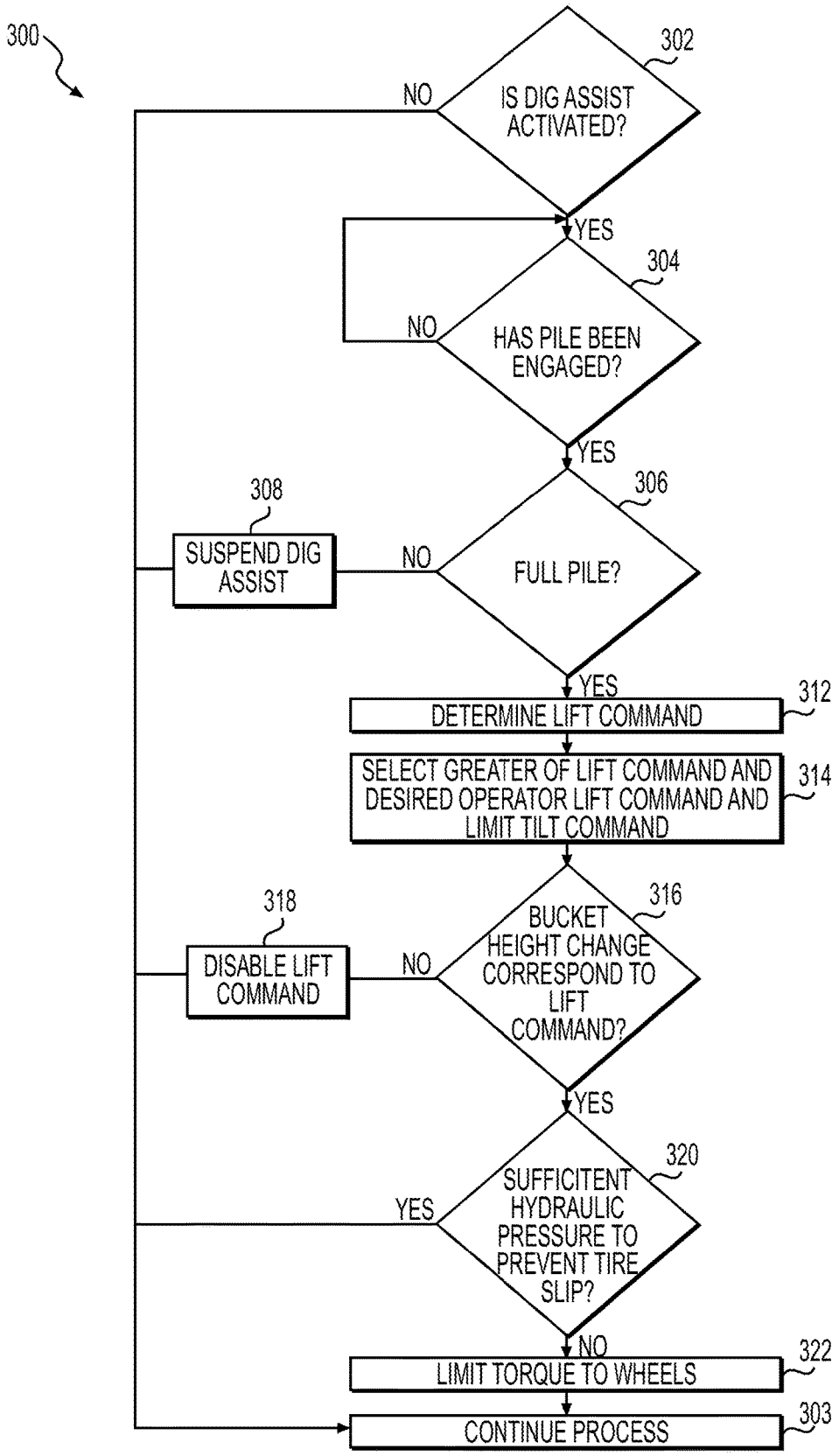
FIG. 3 is a flow diagram showing an exemplary control sequence for providing automatic dig assistance.

FIG. 3 is a flow chart depicting an exemplary process 300 for operating dig assist system 200. In step 302, a component such as controller 204 may determine whether dig assist is activated. For example, controller 204 may examine inputs 202 such as dig assist activate signal input 208. If dig assist is not activated in step 302, then a process may be continued in step 303 without employing dig assist and/or controller 204 may continue to evaluate whether dig assist has been activated. A component such as controller 204 may also determine whether machine 100 is in a dig-ready state. For example, controller 204 may evaluate factors including whether a pedal controlling a brake, neutralizer, or impeller clutch is in a position less than a threshold value for a pre-determined amount of time. Controller 204 may also evaluate, for example, whether ground speed of machine 100 (e.g., via ground speed input 210) falls within a predetermined range of values. As a further example, controller 204 may also determine whether a transmission gear of machine 100 falls within a predetermined range of values. Controller 204 may also evaluate whether, for example, there is no transmission downshift, upshift, or directional shift for a predetermined amount of time. As a further example, controller 204 may evaluate whether an operator lift or tilt command (e.g., from inputs 216 and 222, respectively) or a bucket height or bucket tilt angle (e.g., from inputs 218 and 220, respectively) fall within a predetermined range of values. If a machine 100 is not in a dig-ready state, then controller 204 may continue to evaluate whether machine 100 is in a dig-ready state.

If dig assist is activated, in step 304, a component such as controller 204 may determine whether a pile has been engaged. In determining whether a pile has been engaged, controller 203 may account for factors including rim-pull and/or torque (e.g., from torque out input 212), machine speed (e.g., from ground speed input 210), and/or hydraulic pressure (e.g., from hydraulic pressure input 214). Hydraulic pressure may include or may be equivalent to lift actuator pressure (e.g., a pressure on a cylinder of lift actuator 108). If, at step 304, it is determined that a pile has not been engaged, then step 304 may be repeated. Step 304 may also consider the factors discussed above concerning whether machine 100 is in a dig-ready state.

If it is determined in step 304 that a pile has been engaged, then, in step 306, it is determined whether a full pile is engaged. A full pile is, for example, a pile where a machine 100 will engage in digging and/or loading activities, as opposed to clean-up activities. For example, a full pile may be a pile where a machine 100 experiences a drop in speed to zero upon encountering the full pile, absent a lift command. Engagement of a full pile is indicative of a machine 100 performing digging and/or loading operations as opposed to, for example, cleanup operations. To consider whether a full pile is engaged, in step 306, a component such as controller 204 may evaluate factors including rim-pull and/or torque (e.g., from torque out input 212), hydraulic pressure and/or head pressure (e.g., from hydraulic pressure input 214). Rim-pull and/or torque and/or head pressure may also be analyzed as a function of time. For example, changes in rim-pull and/or torque and/or head pressure may be considered in order to determine whether a full pile is engaged. Step 306 may also calculate the time it will take machine 100 to reach a speed of zero (a time to zero) after engagement with the pile 101. A calculation or measurement of time to zero may consider factors such as ground speed and rate of change of speed (e.g., from ground speed input 210). Time to zero may be used to discriminate between a machine 100 that is engaging a full pile in order to engage in a digging/loading operation, and a machine 100 that is engaging a smaller pile in order to, for example, move the smaller pile toward a bigger pile. A machine 100 encountering a full pile may have a smaller time to zero than a machine encountering a smaller pile. Whereas inputs from groundspeed input 210, torque out input 212 and hydraulic pressure input 214 alone may be ineffective at distinguishing between a full pile and a small pile, consideration of changes in those inputs may be more effective at drawing such distinctions.

Furthermore, in step 306, a controller 204 may distinguish between full piles and smaller piles (e.g., piles having moderate loads) by starting a timer after resistance is detected via inputs 202 and/or measuring the distance machine 100 travels after encountering a suspected full pile (based on the considerations described above). If, in a predetermined amount of time, the criteria for a full pile have not been satisfied, then, in step 306, controller 204 may determine that a full pile is not being engaged and that, for example, only a moderate load is being engaged. In addition or in the alternative, if a distance traveled is greater than a predetermined threshold, then controller 204 may determine that a full pile has not been engaged.

If, at step 306, it is determined that machine 100 is not engaging a full pile, then dig assist system 200 may be suspended by controller 204 in step 308. In other words, dig assist activate signal 208 may be changed so as to deactivate dig assist system 200. Dig assist may be suspended until, for example, machine 100 backs up and moves forward again or, in other words, is shifted from reverse gear to forward gear. After dig assist is suspended in step 308, a process may be continued in step 303. In the alternative, step 308 may be omitted and a process may be continued in step 303 after it is determined in step 306 that a full pile is not engaged.

If, in step 306, controller 204 determines that a full pile is being engaged, then controller 204 may determine and/or calculate a bucket lift command in step 312. For example, a controller 204 may calculate a bucket lift command which would be necessary and/or sufficient to produce sufficient traction between wheels 112 and/or 114 and a ground surface. A controller-generated lift command determined in step 306 may be a function of rim-pull and/or torque (e.g., from torque out input 212) and speed (e.g., from ground speed input 208).

In step 314, controller 204 may compare a lift command generated in step 312 to a desired operator lift command (e.g., from operator bucket lift command input 216). The controller 204 may select the larger of the lift command and the desired operator lift command. Thus, if a lift command generated in step 312 is larger than an input from operator bucket lift command input 216, then controller 204 may deliver the lift command of step 312 as bucket lift command output 230. On the other hand, if an input from operator bucket lift command input 216 is larger than a lift command generated in step 312, then controller 204 may deliver as bucket lift command output 230 the desired operator lift command. Thus, dig assist system 200 allows for operator override in the cases that an operator elects a larger lift command than the lift command calculated by the dig assist system in 312. Dig assist system 200 therefore accounts for operator expertise and judgment and does not unnecessarily interfere with skilled operators.

In step 314, controller 204 may also compare an operator-input bucket tilt command (e.g., from operator bucket tilt command input 222) to a pre-determined or calculated bucket tilt command ceiling value or bucket tilt command upper limit. A command ceiling value or bucket tilt command upper limit may be constant or may be variable depending on, for example, a function of an estimated distance traveled into a pile 101. If an operator-input tilt command is smaller than the tilt command upper limit, then controller 204 may deliver the operator-input tilt command as bucket tilt command 232. On the other hand, if an operator-input tilt command is larger than the tilt command upper limit, then controller 204 may limit the tilt command and deliver a bucket tilt command 232 that is equal to the tilt command upper limit. Limiting a tilt command may prevent unnecessary pulling back and/or racking of bucket 106. Too much tilt command may lead to under-penetration of pile 101. Again, dig assist system 200 allows skilled operators to provide less tilt command if their experience and expertise indicates that less tilt command should be used, preventing dig assist system 200 from interfering with desired commands of a skilled operator.

In step 316, controller 204 may consider whether a height of bucket 106 is changing in accordance with delivered bucket lift command 230. If a height of bucket 106 is changing at a rate that is less than would be expected given bucket lift command 230, then bucket lift command 230 may have stalled out due to, for example, too high of resistance from pile 101. Bucket lift command 230, when delivered, may be indicative of a desired height of bucket 106 and/or a desired change in height of bucket 106. Based on information from, for example, bucket height input 218, controller 204 may determine whether height of bucket 106 is changing at a rate that is indicative of achieving the desired height and/or change of height of bucket 106. For example, controller 204 may use a signal from bucket height input 218 to calculate a rate of change of the height of bucket 106. Controller 204 may compare the rate of change of the height of bucket 106 to the bucket lift command 230. If a bucket height is changing at a rate lower than expected (e.g., a rate lower than a bucket height change derived from the bucket lift command 230), then a lift command may be disabled in step 318. In addition or in the alternative to considering a height of bucket 106, controller 204 may determine whether a high lift resistance has been detected considering, for example, bucket lift command 230, a velocity of a lift actuator 108, a pressure of a cylinder in lift actuator 108 (e.g., from hydraulic pressure input 214), and time. If it is determined that a high lift resistance is detected, then a lift command may be disabled in step 318. A lift command may again be determined, as in step 312 In conjunction with a lift command being disabled in step 318, an operator may provide a command to lower bucket 106 or a throttle of machine 100 may be reduced. In addition or in the alternative, dig assist may be suspended as in step 308 until machine 100 is shifted from reverse gear to forward gear.

If information 218 regarding a height of bucket 106, as described above, does correspond with lift command 230, then controller 204 may determine whether there is sufficient hydraulic pressure to raise the bucket 106 and prevent slip of wheels 112 and/or 114 in step 320. For example, controller 204 may determine whether, considering bucket height input 218, time, hydraulic pressure input 214, and/or other inputs 202, hydraulic pressure is sufficient. Controller 204 may also consider operator bucket lift command 216 and whether operator bucket lift command 216 will be sufficient to generate sufficient hydraulic pressure shortly, even where it may be currently lacking. If hydraulic pressure is determined to be insufficient, and if operator bucket lift command 216 is insufficient to generate the necessary hydraulic pressure, then controller 204 may limit torque to wheels 112 and/or 114 in step 322. For example, controller 204 may limit speed of engine 116 in engine speed command 234 in step 322. Limiting engine speed may serve as a rim-pull limit which will prevent or limit slip of wheels 112 and/or 114. By limiting rim-pull, forward or horizontal force of the machine as transferred from wheels 112 and/or 114 to a ground surface may be decreased. In the alternative to limiting engine speed (as with, e.g., an automatic transmission machine 100), a percentage of clutch engagement may be limited (e.g., with a manual transmission machine 100).

If hydraulic pressure is determined to be sufficient, controller 204 will not limit torque to wheels 112 and/or 114 and the process may continue in step 303. If hydraulic pressure is determined to be insufficient but operator lift command 216 is sufficient to generate the necessary hydraulic pressure, then controller 204 may not limit torque to wheels 112 and/or 114, and the process may continue in step 303. Thus, the dig assist 200 system described herein takes account of operator input and judgment. If the height of bucket 106 as indicated by, for example, bucket height input 216, exceeds a predetermined bucket height indicative of an end of digging or if machine 100 is shifted into reverse gear, indicating an end of a filling process, then dig assist may be suspended as in step 308 until machine 100 shifts from a reverse gear to a forward gear. Limits on tilt and/or torque may also be applied.

INDUSTRIAL APPLICABILITY

The disclosed aspects of the system 200 described herein may be used during operation of a machine 100 in a variety of settings. For instance, dig assist system 200 may be activated by default or may be activated at all times. It may not be necessary to manually deactivate dig assist system 200 (e.g., through dig assist activate signal 208) because dig assist system 200 is capable of distinguishing between full piles and smaller piles and accounts for inputs of expert operators.

Machine 100 may be used for a variety of functions. For example, machine 100 may perform dig and/or loading operations, during which dig assist system 200 may be helpful to prevent slippage of wheels 112 and/or 114. Machine 100 may also perform other operations such as clean-up operations. During a clean-up operation, it may not be necessary to employ the anti-slip techniques of dig assist system 200 (e.g., selecting a lift command and limiting a tilt command in step 314 and/or limiting torque to wheels in step 322). Dig assist system 200 may be capable of determining whether or not a full pile is being engaged (e.g., in step 306) and thus determining whether or not machine 100 is engaged in digging and/or loading operations, where the slip limiting features of dig assist system 200 may be helpful. Thus, dig assist system 200 may employ tire slip limiting features of dig assist system 200 only in appropriate circumstances.

Operators who utilize machines 100 may have a wide range of skill levels. Dig assist system 200 accommodates this wide range of operators. For example, dig assist system 200 provides an operator-input lift command in step 314, where the operator-input lift command exceeds the lift command determined in step 312. Dig assist system 200 also provides an operator-input tilt command in step 314, where the operator-input tilt command is below a threshold amount. If an operator is delivering a sufficient lift command, in step 320, dig assist system 200 may not limit torque to wheels 112 and/or 114. On the other hand, where an operator's commands would potentially result in slip of wheels 112 and/or 114 and/or inefficient usage of machine 100, system 200 optimizes performance of machine 100.

Use of dig assist system 200 helps to prevent unnecessary wear on components of machine 100, including wheels 112, 114. Dig assist system 200 may also help prevent fuel burn due to slipping of wheels 112, 113. Dig assist system 200 also assist in preventing tilt commands which would result in inefficient loading.

It will be apparent to those skilled in the art that various modifications and variations can be made to the disclosed system without departing from the scope of the disclosure. Other embodiments of the system will be apparent to those skilled in the art from consideration of the specification and practice of the machine disclosed herein. It is intended that the specification and examples be considered as exemplary only, with a true scope of the disclosure being indicated by the following claims and their equivalents.

What is claimed is:

1. A system for controlling an earth moving machine, comprising:

a speed sensor configured to communicate a speed signal indicative of a speed of the machine;

an operator bucket lift command input configured to communicate an operator-input bucket lift command; and a controller configured to:

receive the speed signal and the operator-input bucket lift command;

determine a torque of the machine;

using the speed signal and the determined torque, determine a controller-generated bucket lift command; and provide a bucket lift command which is the larger of the operator-input bucket lift command and the controller-generated bucket lift command.

2. The system of claim 1, further comprising:

a pressure sensor configured to communicate a pressure signal indicative of a pressure on a bucket of the machine, and wherein the controller is further configured to:

receive the pressure signal; and using the speed signal, the determined torque, and the pressure signal, determine whether a pile encountered by the machine is a full pile.

3. The system of claim 2, wherein the controller is further configured to:

using at least one of the speed signal, the determined torque, and the pressure signal, determine the time the time it will take the machine to reach a speed of zero; and using the calculated time, determine whether the pile encountered by the machine is a full pile.

4. The system of claim 1, further comprising:

an operator bucket tilt command input configured to communicate an operator-input bucket tilt command, and wherein the controller is further configured to:

provide a bucket tilt command which is the smaller of the operator-input bucket tilt command and a predetermined bucket tilt command ceiling value.

5. The system of claim 1, further comprising:

a bucket height sensor configured to communicate a signal indicative of the height of a bucket of the machine, and wherein the controller is further configured to:

using the signal of the height of the bucket, determine a rate of change of the height of the bucket; and compare the determined rate of change to the provided bucket lift command.

6. The system of claim 5, wherein the controller is further configured to:

calculate the difference between the provided bucket lift command and the determined rate of change; and, if the difference exceeds a predetermined threshold value, disable the provided lift command.

7. The system of claim 1, further comprising:

a bucket height sensor configured to communicate a signal indicative of a height of a bucket of the machine, and wherein the controller is further configured to:

using the signal indicative of the height of the bucket and the provided lift command, determine whether there is sufficient hydraulic pressure to prevent slip of the machine on a ground surface.

8. The system of claim 7, wherein the controller is further configured to:

if there is not sufficient hydraulic pressure, limit torque to the machine.

9. The system of claim 1, further comprising a mechanism for enabling and/or disabling the system.

10. A method for controlling an earth moving machine, comprising:

receiving a speed signal indicative of a speed of the machine;

determining a torque of the machine;

receiving an operator-input bucket lift command;

using the received speed signal and the determined torque, determining a controller-generated bucket lift command; and providing a bucket lift command which is the larger of the operator-input bucket lift command and the controller-generated bucket lift command.

11. The method of claim 10, further comprising:

a receiving a pressure signal indicative of the pressure on a bucket of the machine; and using the speed signal, the determined torque, and the pressure signal, determining whether a pile encountered by the machine is a full pile.

12. The method of claim 11, further comprising using at least one of the speed signal, the determined torque, and the pressure signal, determining the time the time it will take the machine to reach a speed of zero; and using the determined time, determining whether the pile encountered by the machine is a full pile.

13. The method of claim 10, further comprising:

receiving an operator-input bucket tilt command; and providing a bucket tilt command which is the smaller of the operator-input bucket tilt command and a predetermined bucket tilt command ceiling value.

14. The method of claim 10, further comprising:

receiving a signal indicative of a height of a bucket of the machine;

using the signal of the height of the bucket, calculating a rate of change of the height of the bucket of the machine; and comparing the calculated rate of change to the provided bucket lift command.

15. The method of claim 14, further comprising:

calculating the difference between the provided bucket lift command and the calculated rate of change; and if the difference exceeds a predetermined threshold value, disabling the provided lift command.

16. The method of claim 10, further comprising:

receiving a signal indicative of a height of a bucket of the machine; and using the signal indicative of the height of the bucket and the provided lift command, determining whether there is sufficient hydraulic pressure to prevent slip of the machine on a ground surface.

17. The system of claim 16, further comprising:

if there is not sufficient hydraulic pressure, limiting torque to the machine.

18. The system of claim 10, further comprising activating or deactivating the system.

19. A system for controlling an earth moving machine, comprising:

a speed sensor configured to communicate a speed signal indicative of a speed of the machine;

a pressure sensor configured to communicate a pressure signal indicative of the pressure on a bucket of the machine; and a controller configured to:

determine a torque of the machine; and using the speed signal, the determined torque, and the pressure signal, determine whether a pile encountered by the machine is a full pile.

20. The system of claim 19 wherein the controller is further configured to:

using at least one of the speed signal, the determined torque, and the pressure signal, determine the time the time it will take the machine to reach a speed of zero; and using the determined time, determine whether the pile encountered by the machine is a full pile.

* * * * *